US010991303B2

(12) United States Patent
Lee et al.

(10) Patent No.: US 10,991,303 B2
(45) Date of Patent: Apr. 27, 2021

(54) PIXEL CIRCUIT AND DRIVING METHOD THEREOF, DISPLAY DEVICE

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Sangwon Lee, Beijing (CN); Minho Ko, Beijing (CN); Sanghun Kang, Beijing (CN); Wen Tan, Beijing (CN); Young Yik Ko, Beijing (CN); Wanli Dong, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/619,189

(22) PCT Filed: Sep. 6, 2018

(86) PCT No.: PCT/CN2018/104361
§ 371 (c)(1),
(2) Date: Dec. 4, 2019

(87) PCT Pub. No.: WO2019/052394
PCT Pub. Date: Mar. 21, 2019

(65) Prior Publication Data

US 2020/0126478 A1 Apr. 23, 2020

(30) Foreign Application Priority Data

Sep. 18, 2017 (CN) ..... 201710840124.4

(51) Int. Cl.
*G09G 3/325* (2016.01)
*G09G 3/3266* (2016.01)
(Continued)

(52) U.S. Cl.
CPC ..... *G09G 3/325* (2013.01); *G09G 3/3233* (2013.01); *G09G 3/3266* (2013.01); *G09G 3/3275* (2013.01)

(58) Field of Classification Search
CPC .... G09G 3/325; G09G 3/3233; G09G 3/3266; G09G 3/3275; G09G 3/3291;
(Continued)

(56) References Cited

U.S. PATENT DOCUMENTS 7,414,599 B2 8/2008 Chung et al.
7,508,365 B2 3/2009 Kim
(Continued)

FOREIGN PATENT DOCUMENTS

CN 100378784 C 4/2008
CN 100386794 C 5/2008
(Continued)

OTHER PUBLICATIONS

International Preliminary Report on Patentability dated Mar. 24, 2020 in PCT Application No. PCT/CN2018/104361.
(Continued)

*Primary Examiner* — Premal R Patel
(74) *Attorney, Agent, or Firm* — Dilworth & Barrese, LLP.; Michael J. Musella, Esq.

(57) ABSTRACT

A pixel circuit and a driving method thereof and a display device are disclosed. The pixel circuit includes a switch circuit, a driver circuit, a compensation circuit, a reset circuit and a light emitting element. The driver circuit includes a control terminal, a first terminal and a second terminal and is configured to control a driving current, which runs
(Continued)

through the first terminal and the second terminal; the switch circuit is configured to write a data signal to the control terminal in response to a scan signal; the compensation circuit is configured to store the data signal that is written in and electrically connect the control terminal and the second terminal in response to the scan signal; the reset circuit is configured to apply a reset voltage to the compensation circuit in response to a reset signal and electrically connect the control terminal and the first terminal.

20 Claims, 8 Drawing Sheets

(51) Int. Cl.
*G09G 3/3275* (2016.01)
*G09G 3/3233* (2016.01)

(58) Field of Classification Search
CPC ... G09G 2300/0842; G09G 2300/0819; G09G 2300/0861; G09G 2310/0251
See application file for complete search history.

(56) References Cited

U.S. PATENT DOCUMENTS

| | | | | |
|---|---|---|---|---|
| 2013/0335307 | A1 | 12/2013 | Guo et al. | |
| 2014/0118328 | A1* | 5/2014 | Guo | G09G 3/3233 345/212 |
| 2016/0155387 | A1* | 6/2016 | Kim | G09G 3/3291 345/76 |
| 2016/0189606 | A1* | 6/2016 | Chen | G09G 3/3659 345/214 |
| 2018/0166021 | A1* | 6/2018 | Xi | G09G 3/3233 |

FOREIGN PATENT DOCUMENTS

| | | | |
|---|---|---|---|
| CN | 103150991 | A | 6/2013 |
| CN | 104575377 | A | 4/2015 |
| CN | 105590955 | A | 5/2016 |
| CN | 205541822 | U | 8/2016 |
| CN | 106683619 | A | 5/2017 |
| KR | 1020150089476 | A | 8/2015 |

OTHER PUBLICATIONS

International Search Report (ISR) of PCT Application No. PCT/CN2018/104361 and English translation.

* cited by examiner

PIXEL CIRCUIT AND DRIVING METHOD THEREOF, DISPLAY DEVICE

The application claims priority to the Chinese patent application No. 201710840124.4, filed on Sep. 18, 2017, the entire disclosure of which is incorporated herein by reference as part of the present application.

TECHNICAL FIELD

Embodiments of the present disclosure relates to a pixel circuit and a driving method thereof and a display device.

BACKGROUND

An organic light emitting diode (OLED) display device is gradually attracting attention of people because of advantages such as wide view angle, high contrast, rapid response and higher luminance and lower driving voltage compared to an inorganic light emitting display device. Due to the above characteristics, the organic light emitting diode can be applied in a device having a display function, such as a cellphone, a display, a notebook, a digital camera, instrument and apparatus and the like.

A pixel circuit of the OLED display device usually adopts a matrix driving manner, and the matrix driving manner is categorized as an active matrix (AM) driving manner and a passive matrix (PM) driving manner according to whether a switch element is in each pixel unit. A PMOLED is of simple process and low cost but cannot satisfy requirements of high-resolution and large-size display due to disadvantages such as crosstalk, high consumption and short lifetime. In contrast, An AMOLED integrates a set of thin film transistor and storage capacitor in the pixel circuit of each pixel, and controls a current running through the OLED by controlling a driving of the thin film transistor and the storage capacitor, so as to enable the OLED to emit light according to needs. Compared to the PMOLED, the AMOLED needs a smaller driving current and has lower consumption and a longer lifetime, so as to be able to satisfy requirements of high-resolution, multiple-grayscale and large-size display. Meanwhile, The AMOLED has obvious advantages in respects such as visible angle, color rendition, consumption and response time, and is applicable in a high-information content and high-resolution display device.

SUMMARY

At least one embodiment of the present disclosure provides a pixel circuit, which comprises a switch circuit, a driver circuit, a compensation circuit, a reset circuit and a light emitting element. The driver circuit comprises a control terminal, a first terminal and a second terminal and is configured to control a driving current running through the first terminal and the second terminal, and the driving current is used to drive the light emitting element to emit light; the switch circuit is configured to write a data signal to the control terminal of the driver circuit in response to a scan signal; the compensation circuit is configured to store the data signal that is written in and further configured to electrically connect the control terminal of the driver circuit and the second terminal of the driver circuit in response to the scan signal; and the reset circuit is configured to apply a reset voltage to the compensation circuit in response to a reset signal and electrically connect the control terminal of the driver circuit and the first terminal of the driver circuit.

For example, the pixel circuit provided by at least one embodiment of the present disclosure further comprises: a first light emission control circuit configured to apply a first voltage to the second terminal of the driver circuit and the compensation circuit in response to a first light emission control signal.

For example, the pixel circuit provided by at least one embodiment of the present disclosure further comprises: a second light emission control circuit configured to apply the driving current to the light emitting element in response to a second light emission control signal. The second light emission control signal is different from the first light emission control signal.

For example, in the pixel circuit provided by at least one embodiment of the present disclosure, the reset circuit comprises a first reset circuit and a second reset circuit, the first reset circuit is configured to electrically connect the control terminal of the driver circuit and the first terminal of the driver circuit in response to the reset signal, and the second reset circuit is configured to apply the reset voltage to the compensation circuit in response to the reset signal.

For example, in the pixel circuit provided by at least one embodiment of the present disclosure, the second reset circuit is electrically connected with the control terminal of the driver circuit and the compensation circuit so as to apply the reset voltage to the control terminal of the driver circuit and the compensation circuit.

For example, in the pixel circuit provided by at least one embodiment of the present disclosure, the second reset circuit is electrically connected with the second light emission control circuit and the light emitting element, so as to apply the reset voltage to the light emitting element and to apply the reset voltage to the compensation circuit via the first reset circuit.

For example, in the pixel circuit provided by at least one embodiment of the present disclosure, the driver circuit comprises a first transistor, a gate electrode of the first transistor serves as the control terminal of the driver circuit and is connected with a first node, a first electrode of the first transistor serves as the first terminal of the driver circuit and is connected with a third node, and a second electrode of the first transistor serves as the second terminal of the driver circuit and is connected with a second node.

For example, in the pixel circuit provided by at least one embodiment of the present disclosure, the switch circuit comprises a second transistor, a gate electrode of the second transistor is configured to be connected with a scan signal terminal so as to receive the scan signal, a first electrode of the second transistor is configured to be connected with a data signal terminal so as to receive the data signal, and a second electrode of the second transistor is connected with the third node.

For example, in the pixel circuit provided by at least one embodiment of the present disclosure, the compensation circuit comprises a third transistor and a storage capacitor, a gate electrode of the third transistor is configured to be connected with a scan signal terminal so as to receive the scan signal, a first electrode of the third transistor is connected with the second node, a second electrode of the second transistor is connected with a first electrode of the storage capacitor, and a second electrode of the storage capacitor is configured to be connected with a first voltage terminal so as to receive the first voltage.

For example, in the pixel circuit provided by at least one embodiment of the present disclosure, the first light emission control circuit comprises a fourth transistor, a gate electrode of the fourth transistor is configured to be connected with a first light emission control terminal so as to receive the first light emission control signal, a first electrode of the fourth transistor is configured to be connected with a first voltage terminal so as to receive the first voltage, and a second electrode of the fourth transistor is connected with the second node.

For example, in the pixel circuit provided by at least one embodiment of the present disclosure, the second light emission control circuit comprises a fifth transistor, a gate electrode of the fifth transistor is configured to be connected with a second light emission control terminal so as to receive the second light emission control signal, a first electrode of the fifth transistor is connected with the third node, and a second electrode of the fifth transistor is connected with a first electrode of the light emitting element, and a second electrode of the light emitting element is configured to be connected with a second voltage terminal so as to receive a second voltage.

For example, in the pixel circuit provided by at least one embodiment of the present disclosure, the first reset circuit comprises a sixth transistor, a gate electrode of the sixth transistor is configured to be connected with a reset control terminal so as to receive the reset signal, a first electrode of the sixth transistor is connected with the first node, and a second electrode of the sixth transistor is connected with the third node.

For example, in the pixel circuit provided by at least one embodiment of the present disclosure, the second reset circuit comprises a seventh transistor, a gate electrode of the seventh transistor is configured to be connected with a reset control terminal to receive the reset signal, a first electrode of the seventh transistor is connected with the first node, and a second electrode of the seventh transistor is configured to be connected with the a reset voltage terminal to receive the reset voltage.

For example, in the pixel circuit provided by at least one embodiment of the present disclosure, the second reset circuit comprises a seventh transistor, a gate electrode of the seventh transistor is configured to be connected with a reset control terminal so as to receive the reset signal, a first electrode of the seventh transistor is connected with a first electrode of the light emitting element, and a second electrode of the seventh transistor is configured to be connected with the a reset voltage terminal so as to receive the reset voltage.

For example, in the pixel circuit provided by at least one embodiment of the present disclosure, the second light emission control signal and the reset signal are at least turn-on signals at same time.

At least one embodiment of the present disclosure further provides a display device, which comprises: a plurality of pixel units which are arranged in an array, a plurality of scan signal lines, a plurality of data signal lines and a plurality of reset control lines. Each of the plurality of pixel units comprises any one of the pixel circuits provided by the embodiments of the present disclosure; a scan signal line in each row is connected with switch circuits and compensation circuits of pixel circuits in the each row to provide a scan signal; a data signal line in each column is connected with switch circuits of pixel circuits in the each column to provide a data signal; and a reset control line in the each row is connected with reset circuits of the pixel circuits in the each row to provide a reset signal.

For example, the display device provided by at least one embodiment of the present disclosure further comprises a plurality of light emission control lines. Each pixel circuit further comprises: a first light emission control circuit configured to apply a first voltage to a second terminal of a driver circuit and a compensation circuit of the each pixel circuit in response to a first light emission control signal; and a second light emission control circuit configured to apply a driving current of the each pixel circuit to a light emitting element of the each pixel circuit in response to a second light emission control signal, wherein the second light emission control signal is different from the first light emission control signal. First light emission control circuits of pixel circuits in an Nth row is connected with a light emission control line in the Nth row; second light emission control circuits of the pixel circuits in the Nth row is connected with a light emission control line in an (N+1)th row; first light emission control circuits of pixel circuits in the (N+1)th row is connected with the light emission control line in the (N+1)th row; and N is an integer larger than zero.

At least one embodiment of the present disclosure further provides a driving method of a pixel circuit, and the driving method comprises a reset stage, a data writing and compensation stage, and a light emitting stage. During the reset stage, the reset signal is input, the reset circuit is turned on, and the compensation circuit and the driver circuit are reset; during the data writing and compensation stage, the scan signal and the data signal are input, all of the switch circuit, the driver circuit and the compensation circuit are turned on, the switch circuit writes the data signal into the driver circuit, and the compensation circuit compensates the driver circuit; and during the light emitting stage, the driver circuit drives the light emitting element to emit light.

At least one embodiment of the present disclosure further provides a driving method of a pixel circuit, and the driving method comprises a reset stage, a data writing and compensation stage, a charging and holding stage, and a light emitting stage. During the reset stage, the reset signal and the second light emission control signal are input, all of the first reset circuit, the second reset circuit and the second light emission control circuit are turned on, and all of the compensation circuit, the driver circuit and the light emitting element are reset; during the data writing and compensation stage, the scan signal and the data signal are input, all of the switch circuit, the driver circuit and the compensation circuit are turned on, the switch circuit writes the data signal into the driver circuit, and the compensation circuit compensates the driver circuit; during the charging and holding stage, the first light emission control signal is input, the first light emission control circuit and the driver circuit are turned on, and the first light emission control circuit applies the first voltage to the driver circuit and holds a voltage at a control terminal of the driver circuit; and during the light emitting stage, the first light emission control signal and the second light emission control signal are input, all of the first light emission control circuit, the second light emission control circuit and the driver circuit are turned on, and the second light emission control circuit applies the driving current to the light emitting element to enable the light emitting element to emit light, wherein the second light emission control signal is different from the first light emission control signal, and the second light emission control signal and the reset signal are at least turn-on signals at same time.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment (s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "left," "right" and the like are only used to indicate relative position relationship, and when the position of the object which is described is changed, the relative position relationship may be changed accordingly.

Figure 1A:
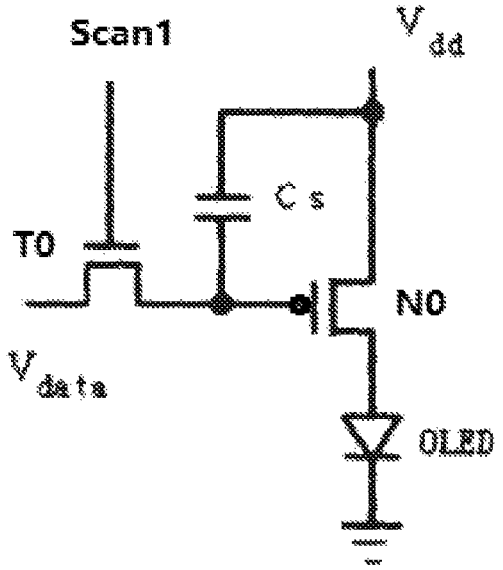
FIG. 1A is a schematic diagram of a 2T1C pixel circuit.
Figure 1B:
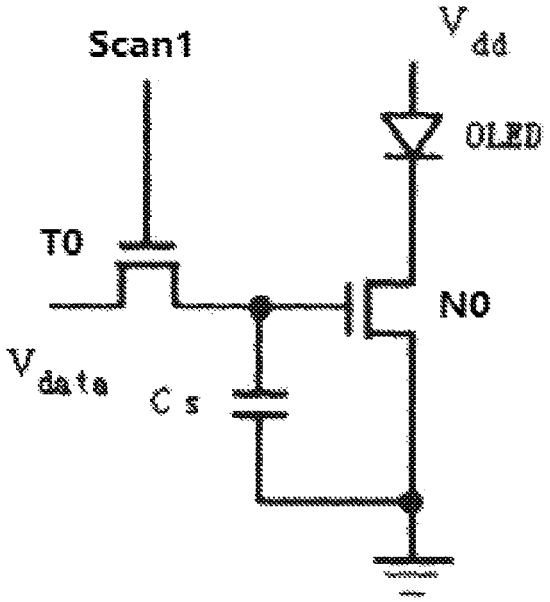
FIG. 1B is a schematic diagram of another 2T1C pixel circuit.

A basic pixel circuit used in an AMOLED display device is usually a 2T1C pixel circuit, that is, two thin film transistors (TFTs) and one storage capacitor are used to realize a basic function of driving the OLED to emit light. FIG. 1A and FIG. 1B respectively illustrate schematic diagrams of two types of 2T1C pixel circuits.

As illustrated in FIG. 1A, a type of 2T1C pixel circuit includes a switch transistor T0, a driving transistor N0 and a storage capacitor Cs. For example, a gate electrode of the switch transistor T0 is connected with a gate line to receive a scan signal Scant; for example, a source electrode of the switch transistor T0 is connected with a data line to receive a data signal Vdata, and a drain electrode of the switch transistor T0 is connected with a gate electrode of the driving transistor N0. A source electrode of the driving transistor N0 is connected with a first voltage terminal to receive a first voltage Vdd (a high voltage), and a drain electrode of the driving transistor N0 is connected with the anode of the OLED. One terminal of the storage capacitor Cs is connected with the drain electrode of the switch transistor T0 and the gate electrode of the driving transistor N0, and the other terminal of the storage capacitor Cs is connected with the source electrode of the driving transistor N0 and the first voltage terminal. The cathode of the OLED is connected with a second voltage terminal to receive a second voltage Vss (a low voltage, a grounded voltage for example). A driving manner of the 2T1C pixel circuit is to control bright and dark (a greyscale) of a pixel by the two TFTs and the storage capacitor Cs. When the scan signal Scant is applied by the gate line to turn on the switch transistor T0, the data signal (Vdata) which is inputted through the data line by a data driver circuit charges the storage capacitor Cs through the switch transistor T0, so as to store the data signal in the storage capacitor Cs. The data signal that is stored controls a conduction degree of the driving transistor N0, so as to control a value of a current which runs through the driving transistor N0 and drives the OLED to emit light; that is, the current determines an emission greyscale of the pixel. In the 2T1C pixel circuit as illustrated in FIG. 1A, the switch transistor T0 is an n-type transistor, and the driving transistor N0 is a p-type transistor.

As illustrated in FIG. 1B, another type of 2T1C pixel circuit also includes a switch transistor T0, a driving transistor N0 and a storage capacitor Cs, but the connection manner is slightly different, and the driving transistor N0 is an n-type transistor. Difference of the pixel circuit of FIG. 1B compared to the pixel circuit of FIG. 1A includes: the anode of the OLED is connected with the first voltage terminal to receive the first voltage Vdd (a high voltage), the cathode of the OLED is connected with the drain electrode of the driving transistor N0, and the source electrode of the driving electrode N0 is connected with the second voltage terminal to receive the second voltage Vss (a low voltage, a grounded voltage for example). One terminal of the storage capacitor Cs is connected with the drain electrode of the switch transistor T0 and the gate electrode of the driving transistor N0, and the other terminal of the storage capacitor Cs is connected with the source electrode of the driving transistor N0 and the second voltage terminal. The operation manner of the 2T1C pixel circuit is substantially same as the pixel circuit as illustrated in FIG. 1A, which is not repeated here.

Additionally, for the pixel circuits as illustrated in FIG. 1A and FIG. 1B, the switch transistor T0 is not limited to an n-type transistor and may also be a p-type transistor, and a polarity of the scan signal Scan1 controlling the switch transistor T0 to turn on or turn off is accordingly changed.

An OLED display device usually includes a plurality of pixel units arranged in an array, and each pixel circuit may include the above-mentioned pixel circuit for example. In the OLED display device, a threshold voltage of the driving transistor of each pixel circuit can vary due to a manufacturing process, and the threshold voltage of the driving transistor can drift because of, for example, the influence of a variation of temperature. Difference in threshold voltages of thin film transistors can cause display defects (e.g., display mura). As a result, the threshold voltages of the thin film transistors need to be compensated. In addition, display defects can also be caused by off-state leaking current.

Therefore, industry provides other pixel circuits having a compensation function based on the above basic 2T1C pixel circuit, and the compensation function can be realized through a voltage compensation, a current compensation or a hybrid compensation. The pixel circuit having the compensation function may adopt a 4T1C or 4T2C structure for example, which is not described in detail here.

At least one embodiment of the present disclosure provides a pixel circuit, and the pixel circuit includes switch circuit, a driver circuit, a compensation circuit, a reset circuit and a light emitting element. The driver circuit comprises a control terminal, a first terminal and a second terminal and is configured to control a driving current, which runs through the first terminal and the second terminal and is used to drive the light emitting element to emit light; the switch circuit is configured to write a data signal to the control terminal of the driver circuit in response to a scan signal; the compensation circuit is configured to store the data signal that is written in and further configured to electrically connect the control terminal of the driver circuit and the second terminal of the driver circuit in response to the scan signal; the reset circuit is configured to apply a reset voltage to the compensation circuit in response to a reset signal and electrically connect the control terminal of the driver circuit and the first terminal of the driver circuit. At least one embodiment of the present disclosure further provides a driving method corresponding to the above-mentioned pixel circuit and a display device.

The pixel circuit and the driving method thereof and the display device provided by embodiments of the present disclosure can compensate a threshold voltage of the driver circuit. At the same time, because the control terminal of the driver circuit in the pixel circuit has two leakage paths with opposite polarities, leakage currents can be compensated for each other, so that a leakage current in an off state is reduced, and a display effect is improved.

Embodiments of the present disclosure and examples thereof are described in detail below in combination with the accompanying drawings.

Figure 2:
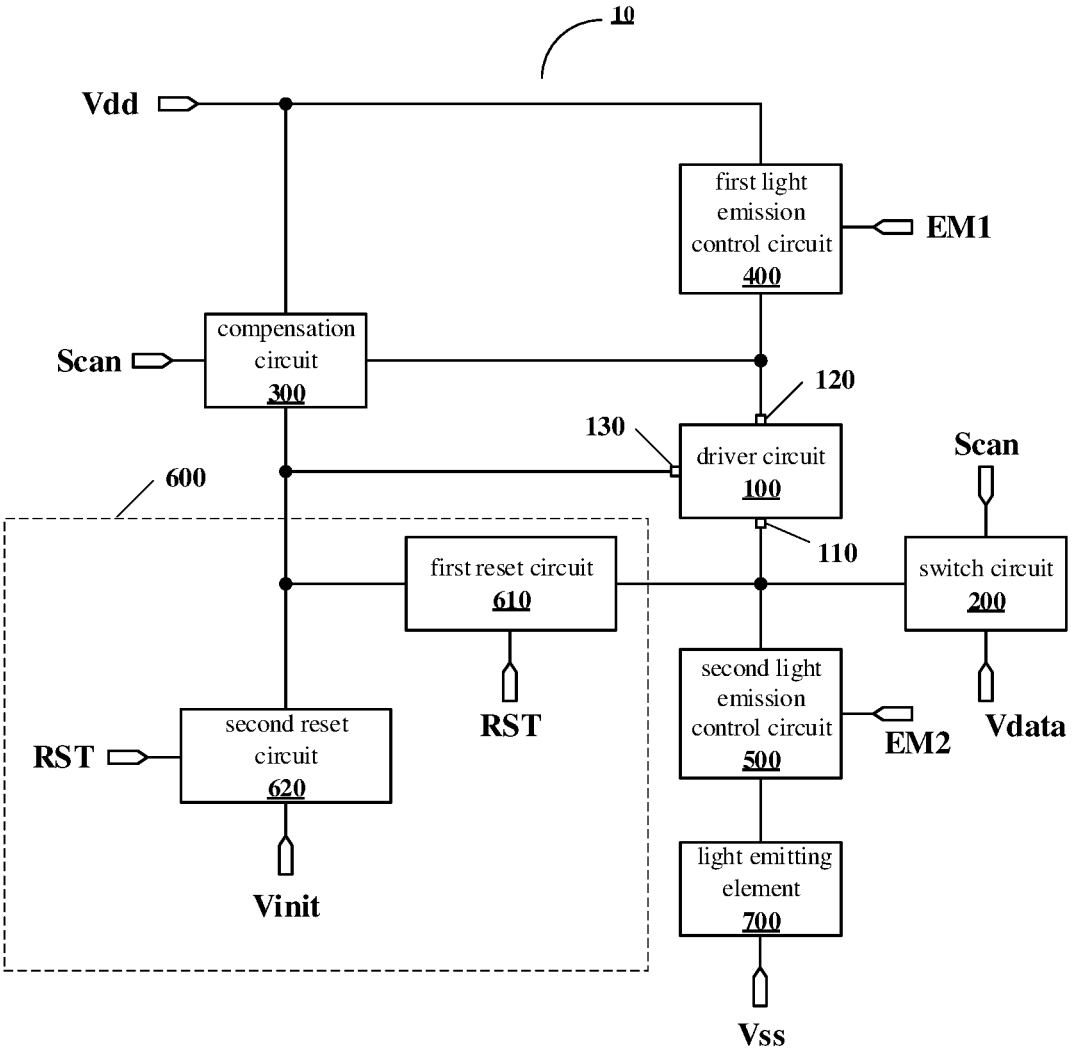
FIG. 2 is a schematic block diagram of a pixel circuit provided by an embodiment of the present disclosure.

An embodiment of the present disclosure provides a pixel circuit 10, and the pixel circuit 10 is applied in a sub-pixel of an OLED display device for example. As illustrated in FIG. 2, the pixel circuit 10 includes a driver circuit 100, a switch circuit 200, a compensation circuit 300, a reset circuit 600 and a light emitting element 700.

For example, the driver circuit 100 includes a first terminal 110, a second terminal 120 and a control terminal 130, and the driver circuit 100 is configured to control a driving current which runs through the first terminal 110 and the second terminal 120, and the driving current is used to drive the light emitting element 700 to emit light. For example, during a light emitting stage, the driver circuit 100 can provide the driving current to the light emitting element 700 to drive the light emitting element 700 to emit light, and the light emitting element 700 emits light according to a gray-scale required. For example, the light emitting element 700 is an OLED, however, embodiments of the present disclosure include but are not limited to this case.

For example, the switch circuit 200 is configured to write a data signal Vdata to the control terminal 130 of the driver circuit 100 in response to a scan signal Scan. For example, during a data writing and compensation stage, the switch circuit 200 is turned on in response to the scan signal Scan so as to write the data signal Vdata into the control terminal 130 of the driver circuit 100, and the data signal Vdata that is written in is stored in the compensation circuit 300, and thus during a light emitting stage, the driving current which drives the light emitting element 700 to emit light is generated according to the data signal Vdata.

For example, the compensation circuit 300 is configured to store the data signal Vdata that is written in and electrically connect the control terminal 130 and the second terminal 120 of the driver circuit 100 in response to the Scan signal Scan. For example, in a case where the compensation circuit 300 includes a storage capacitor, during the data writing and compensation stage, the compensation circuit is turned on in response to the scan signal Scan, so that the data signal Vdata written via the switch circuit 200 is stored in the storage capacitor. For example, at the same time, during the data writing and compensation stage, the compensation circuit 300 electrically connects the control terminal 130 and the second terminal 120 of the driver circuit 100, so that relevant information of the threshold voltage of the driver circuit is correspondingly stored in the storage capacitor, and thus the driver circuit can be controlled by a stored voltage including the data signal and the threshold voltage during the light emitting stage, and thereby compensating the driver circuit.

For example, the reset circuit 600 is configured to apply a reset voltage Vinit to the compensation circuit 300 in response to a reset signal RST, and electrically connect the control terminal 130 and the first terminal 110 of the driver circuit 100. For example, in a reset stage, the reset circuit 600 is turned on in response to the reset signal RST, so that the reset voltage Vinit is applied to the compensation circuit 300 to perform a reset operation on the compensation circuit 300. For example, in other examples, the reset circuit 600 resets the light emitting element 700 simultaneously when resetting the compensation circuit 300.

The pixel circuit 10 provided by at least one embodiment of the present disclosure can compensate the threshold voltage inside the driver circuit 100 so that the driving current which drives the light emitting element 700 is not affected by the threshold voltage, thereby improving the display effect of the display device adopting the pixel circuit and prolonging a service life of the light emitting element 700. Meanwhile, the compensation circuit 300 is configured to be capable of electrically connecting the control terminal 130 and the second terminal 120 of the driver circuit 100, and the reset circuit 600 is configured to be capable of electrically connecting the control terminal 130 and the first terminal 110 of the driver circuit 100. In this way, the control terminal 130 of the driver circuit 100 can have two leakage paths with opposite polarities, and the leakage currents through the two leakage paths can realize mutual compensation, thereby reducing the leakage current in the off state and improving the display effect.

For example, as illustrated in FIG. 2, in another embodiment of the present disclosure, the pixel circuit 10 further includes a first light emission control circuit 400 configured to apply a first voltage Vdd to both the second terminal 120 of the driver circuit 100 and the compensation circuit 300 in response to a first light emission control signal EM1. For example, the first voltage Vdd is a driving voltage, such as a high voltage.

For example, during the light emitting stage, the first light emission control circuit 400 is turned on in response to the first light emitting control signal EM1, so that the first voltage Vdd is applied to the second terminal 120 of the driver circuit 100. When the driver circuit 100 is turned on, it is easy to understand that the electric potential of the first terminal 110 is also Vdd. Then, the driver circuit 100 applies the first voltage Vdd to the light emitting element 700, so as to provide the driving voltage to drive the light emitting element to emit light. For example, in some embodiments, during the charging and holding stage (for example, the charging and holding stage is before the light emitting stage), the first light emission control circuit 400 can be turned on in response to the first light emission control signal EM1, so that the first terminal 110 of the driver circuit 100 can be charged up to the first voltage Vdd before the light emitting stage.

For example, as illustrated in FIG. 2, in another embodiment of the present disclosure, the pixel circuit 10 further includes a second light emission control circuit 500 configured to apply the driving current to the light emitting element 700 in response to a second light emission control signal EM2.

For example, during the light emitting stage, the second light emission control circuit 500 is turned on in response to the second light emission control signal EM2, so that the driver circuit 100 applies the driving current to the light emitting element 700 via the second light emission control circuit 500 to enable the light emitting element 700 to emit light; in a non-light emitting stage, the second light emission control circuit 500 is turned off in response to the second light emission control signal EM2, thereby preventing the light emitting element 700 from emitting light, improving a contrast of a corresponding display device and prolonging the service life of the light emitting element 700. For another example, in some examples, during the reset stage, the second light emission control circuit 500 is turned on in response to the second light emission control signal EM2, and thus the second light emission control circuit 500 performs a reset operation on the light emitting element 700 in conjunction with the reset circuit 600.

For example, the second light emission control signal EM2 is different from the first light emission control signal EM1, for example, the second light emission control signal EM2 and the first light emission control signal EM1 are respectively connected to different signal output terminals. As described above, for example, in the reset stage, the second light emission control signal EM2 can be allowed to be a turned-on signal individually, while in the light emitting stage, both of the first light emission control signal EM1 and the second light emission control signal EM2 can be allowed to be a turned-on signal.

It should be noted that in embodiments of the present disclosure, the first light emission control signal EM1 and the second light emission control signal EM2 are used to distinguish two light emission control signals with different timing. For example, in a display device, the pixel circuits 10 are arranged in an array, the first light emission control signal EM1 is a control signal for controlling the first light emission control circuits 400 of the pixel circuits 10 in a present row, and meanwhile the first light emission control signal EM1 also controls the second light emission control circuits 500 of the pixel circuits 10 in a previous row; similarly, the second light emission control signal EM2 is a control signal for controlling the second light emission control circuits 500 of the pixel circuits 10 in the present row, and meanwhile the second light emission control signal EM2 also controls the first light emission control circuits 400 of the pixel circuits 10 in a next row.

For example, as illustrated in FIG. 2, in an embodiment of the present disclosure, the reset circuit 600 may include a first reset circuit 610 and a second reset circuit 620. The first reset circuit 610 electrically connects the control terminal 130 and the first terminal 110 of the driver circuit 100 in response to the reset signal RST, and the second reset circuit 620 applies the reset voltage Vinit to the compensation circuit 300 in response to the reset signal RST.

For example, as illustrated in FIG. 2, in an example, the second reset circuit 620 is connected to the control terminal 130 and the compensation circuit 300 of the driver circuit 100, so as to apply the reset voltage Vinit to both the control terminal 130 and the compensation circuit 300 of the driver circuit 100.

Figure 3:
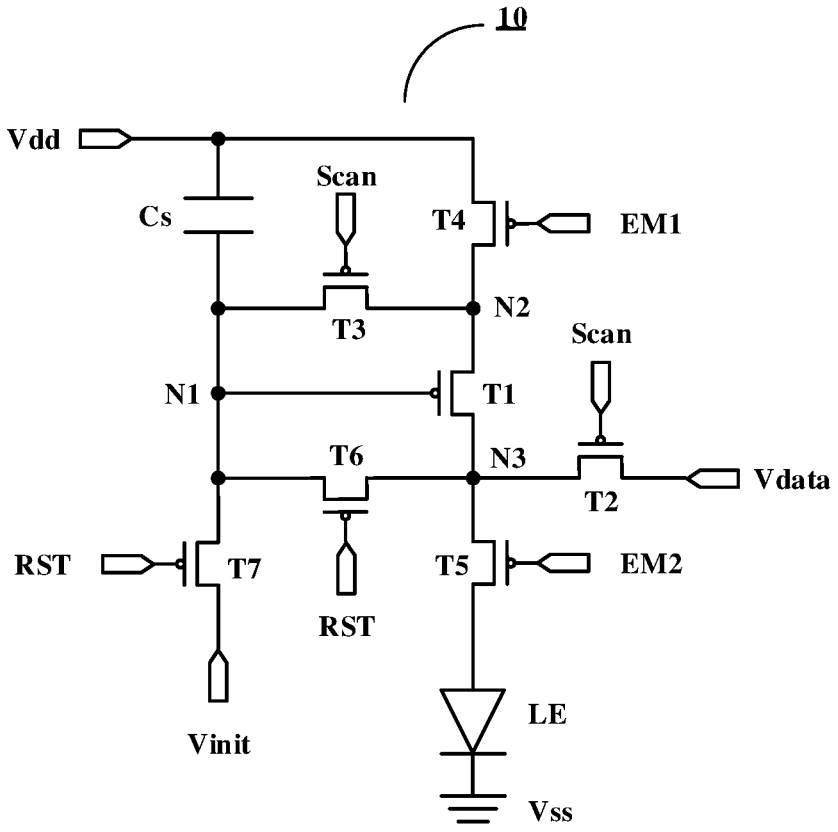
FIG. 3 is a circuit diagram of a specific implementation example of the pixel circuit as illustrated in FIG. 2.

For example, the pixel circuit 10 illustrated in FIG. 2 can be implemented as the pixel circuit as illustrated in FIG. 3. As illustrated in FIG. 3, the pixel circuit 10 includes a first transistor T1, a second transistor T2, a third transistor T3, a fourth transistor T4, a fifth transistor T5, a sixth transistor T6, a seventh transistor T7, and further includes a storage capacitor Cs and a light emitting element LE. For example, the first transistor T1 is used as a driving transistor, and the other transistors (that is, the second transistor T2 to the seventh transistor T7) are used as switch transistors. For example, the light emitting element LE may adopt an OLED, and embodiments of the present disclosure include but are not limited to this case. The following embodiments are all described by taking the case that the light emitting element LE is the OLED as an example and are not described in detail. The OLED may be of various types, such as top emission, bottom emission, etc., and may emit red light, green light, blue light, white light, etc. No limitation will be given in the embodiments of the present disclosure in this respect.

For example, as illustrated in FIG. 3, more specifically, the driver circuit 100 may be implemented as the first transistor T1. A gate electrode of the first transistor T1 serves as the control terminal 130 of the driver circuit 100 and is connected with a first node N1, a first electrode of the first transistor T1 serves as the first terminal 110 of the driver circuit 100 and is connected with a third node N3, and a second electrode of the first transistor T1 serves as the second terminal 120 of the driver circuit 100 and is connected with a second node N2.

The switch circuit 200 may be implemented as the second transistor T2. A gate electrode of the second transistor T2 is configured to be connected with a scan signal terminal to receive the scan signal Scan, a first electrode of the second transistor T2 is configured to be connected with a data signal terminal to receive the data signal Vdata, and a second electrode of the second transistor T2 is connected to the third node N3.

The compensation circuit 300 may be implemented to include the third transistor T3 and the storage capacitor Cs. A gate electrode of the third transistor T3 is configured to be connected to the scan signal terminal to receive the scan signal Scan, a first electrode of the third transistor T3 is connected to the second node N2, a second electrode of the third transistor T3 is connected to a first electrode of the storage capacitor Cs, and a second electrode of the storage capacitor Cs is configured to be connected to a first voltage terminal to receive the first voltage Vdd.

The first light emission control circuit 400 may be implemented as the fourth transistor T4. A gate electrode of the fourth transistor T4 is configured to be connected to a first light emission control terminal to receive the first light emission control signal EM1, a first electrode of the fourth transistor T4 is configured to be connected to the first voltage terminal to receive the first voltage Vdd, and a second electrode of the fourth transistor T4 is connected to the second node N2.

The second light emission control circuit 500 may be implemented as the fifth transistor T5. A gate electrode of the fifth transistor T5 is configured to be connected to a second light emission control terminal to receive the second light emission control signal EM2, a first electrode of the fifth transistor T5 is connected to the third node N3, a second electrode of the fifth transistor T5 is connected to a positive terminal of the light emitting element LE, and a negative terminal of the light emitting element LE is configured to be connected to a second voltage terminal to receive a second voltage Vss. For example, the second voltage terminal is grounded, that is, Vss is equal to 0 V.

The first reset circuit 610 may be implemented as the sixth transistor T6. A gate electrode of the sixth transistor T6 is configured to be connected to a reset control terminal to receive the reset signal RST, the first electrode of the sixth transistor T6 is connected to the first node N1, and a second electrode of the sixth transistor T6 is connected to the third node N3.

The second reset circuit 620 may be implemented as the seventh transistor T7. A gate electrode of the seventh transistor T7 is configured to be connected to the reset control terminal to receive the reset signal RST, a first electrode of the seventh transistor T7 is connected to the first node N1, and a second electrode of the seventh transistor T7 is configured to be connected to a reset voltage terminal to receive the reset voltage Vinit. For example, the reset voltage Vinit may be equal to 0V (or other signals with low-level, etc.).

In the pixel circuit as illustrated in FIG. 3, when the fifth transistor T5, the sixth transistor T6 and the seventh transistor T7 are all turned on (for example, both the second light emission control signal EM2 and the reset signal RST are turn-on signals), both the first node N1 and the light emitting element LE are written with the reset voltage Vinit, that is, the reset operation is performed with respect to all of the storage capacitor Cs, the control terminal of the first transistor T1 and the light emitting element.

When the third transistor T3 is turned on, the gate electrode (the first node N1) and the second electrode (the second node N2) of the first transistor T1 can be connected. In this case, the first transistor T1 is in a connection mode allowing the first transistor T1 to be similar to a diode, so that the data signal Vdata can be stored in the storage capacitor Cs. Meanwhile, the threshold voltage of the first transistor T1 (the driving transistor) can also be compensated by the first transistor T1 itself.

In addition, as illustrated in FIG. 3, the third transistor T3 and the sixth transistor T6 are symmetrically disposed, the third transistor T3 is between the gate electrode and the second electrode of the first transistor T1, and the sixth transistor T6 is between the gate electrode and the first electrode of the first transistor T1. With this connection mode, the first node N1 has two leakage paths with opposite polarities, and the leakage currents can be compensated for each other, so that the leakage current in the off state is reduced, and the display effect of the display device adopting the pixel circuit is improved.

It should be noted that all transistors adopted in the embodiments of the present disclosure may be thin film transistors, field-effect transistors or other switching devices with same characteristics, and the case where the transistors are thin film transistors is taken as an example to illustrate the embodiments of the present disclosure. A source electrode and a drain electrode of a transistor adopted herein may be symmetric in structure, so the source electrode and the drain electrode are not different structurally. In the embodiments of the present disclosure, in order to distinguish the two electrodes apart from the gate electrode, one electrode is described as a first electrode and the other electrode is described as a second electrode.

Additionally, it should be noted that the embodiments of the present disclosure are described by taking the case where all the transistors in the embodiments of the present disclosure are P-type transistors as an example. In this situation, the first electrode may be a drain electrode and the second electrode may be a source electrode. It should be noted that the present disclosure includes but is not limited to this case. For example, all the transistors in the embodiments of the present disclosure may adopt N-type transistors. In this case, the first electrode may be a drain electrode and the second electrode may be a source electrode. For another example, the transistors in the embodiment of the present disclosure may include both P-type transistors and N-type transistors, and it is only required that polarities of terminals of the selected types of transistors are connected correspondingly according to the polarities of the terminals of the corresponding transistors in the embodiment of the present disclosure.

Figure 4:
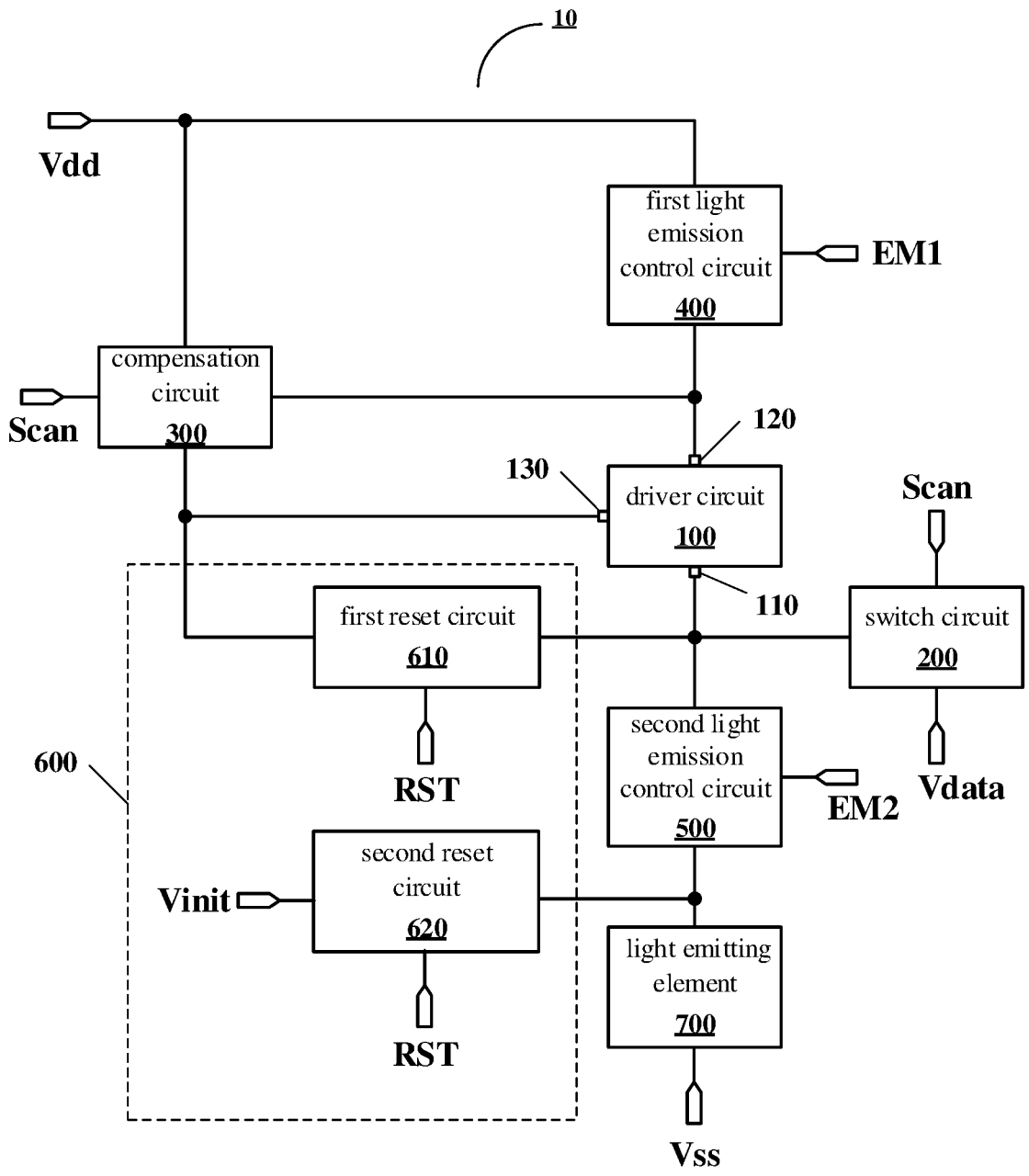
FIG. 4 is a schematic block diagram of another pixel circuit provided by an embodiment of the present disclosure.

Another embodiment of the present disclosure provides a pixel circuit 10, and as illustrated in FIG. 4, the pixel circuit differs from the pixel circuit illustrated in FIG. 2 in the connection mode of the second reset circuit 620, in which the second reset circuit 620 is connected with both the second light emission control circuit 500 and the light emitting element 700, so as to apply the reset voltage Vinit to the light emitting element 700, and to apply the reset voltage Vinit to the compensation circuit 300 via the second light emission control circuit 500 and the first reset circuit 610.

For example, as illustrated in FIG. 4, when both of the reset signal RST and the second light emission control signal EM2 are turn-on signals, all of the first reset circuit 610, the second reset circuit 620 and the second light emission control circuit 500 are turned on, and the reset voltage Vinit are applied to all of the compensation circuit 300, the control terminal 130 of the driver circuit 100 and the light emitting element 700, so that a reset operation is perform with respect to all of the compensation circuit 300, the control terminal 130 of the driver circuit 100 and the light emitting element 700.

The descriptions regarding the driver circuit 100, the switch circuit 200, the compensation circuit 300, the first light emission control circuit 400, the second light emission control circuit 500, the reset circuit 600 and the light emitting element 700 may refer to the corresponding descriptions in the embodiment as illustrated in FIG. 2 and are not repeated here.

Figure 5:
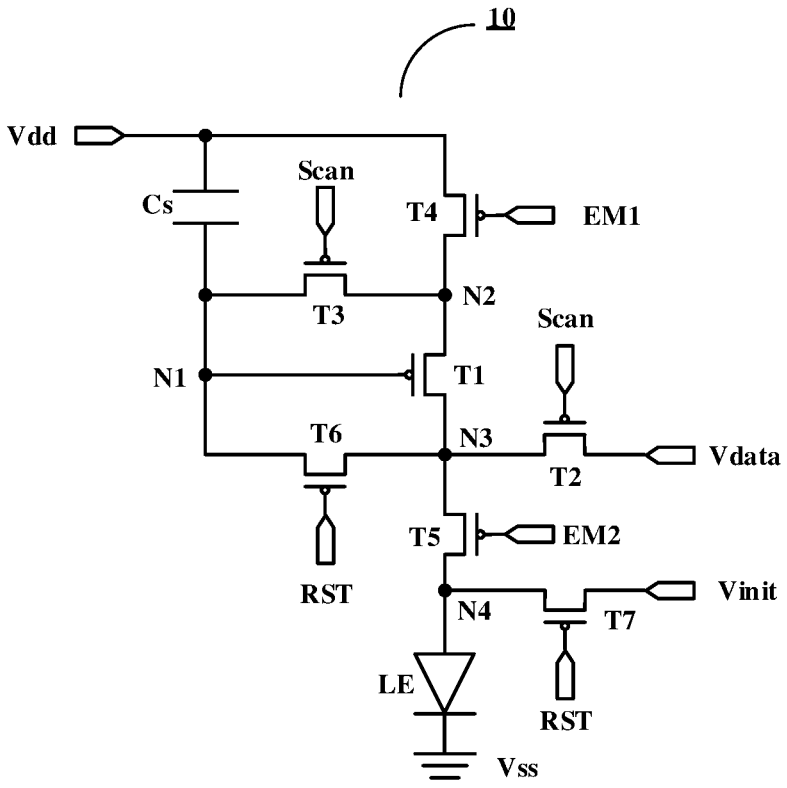
FIG. 5 is a circuit diagram of a specific implementation example of the pixel circuit as illustrated in FIG. 4.

For example, the pixel circuit 10 as illustrated in FIG. 4 is similarly to the embodiment as illustrated in FIG. 2, and the pixel circuit 10 as illustrated in FIG. 4 may be implemented as the pixel circuit structure as illustrated in FIG. 5. As illustrated in FIG. 5, the pixel circuit 10 includes a first transistor T1, a second transistor T2, a third transistor T3, a fourth transistor T4, a fifth transistor T5, a sixth transistor T6, a seventh transistor T7, and includes a storage capacitor Cs and a light emitting element LE. For example, the first transistor T1 is used as a driving transistor, and the other transistors (that is, the second transistor T2 to the seventh transistor T7) are used as switch transistors.

The pixel circuit 10 as illustrated in FIG. 5 differs from the pixel circuit illustrated in FIG. 3 in the connection mode of the seventh transistor T7, in which a first electrode of the seventh transistor T7 is connected to the positive terminal of the light emitting element LE (that is, connected to the fourth node N4). For example, the negative terminal of the light emitting element LE is connected to the second voltage terminal to receive the second voltage Vss. For example, the second voltage terminal is grounded, that is, Vss is equal to 0 V, for example, the second voltage terminal is a common voltage terminal of the display device, that is, the pixel circuits of all sub-pixels use the same second voltage terminal.

The other transistors and the storage capacitor Cs as illustrated in FIG. 5 can refer the descriptions in the embodiment as illustrated in FIG. 3 and are not described again here.

It should be noted that the embodiments of the present disclosure are all described by taking the case where that the negative terminal of the light emitting element is connected to the second voltage Vss (low voltage) as an example. The embodiments of the present disclosure include but are not limited to this case. For example, the first voltage Vdd (high voltage) (for example, the common voltage terminal) is applied to the positive terminal of the light emitting element LE, while the negative terminal is directly or indirectly connected to the driver circuit.

Figure 6:
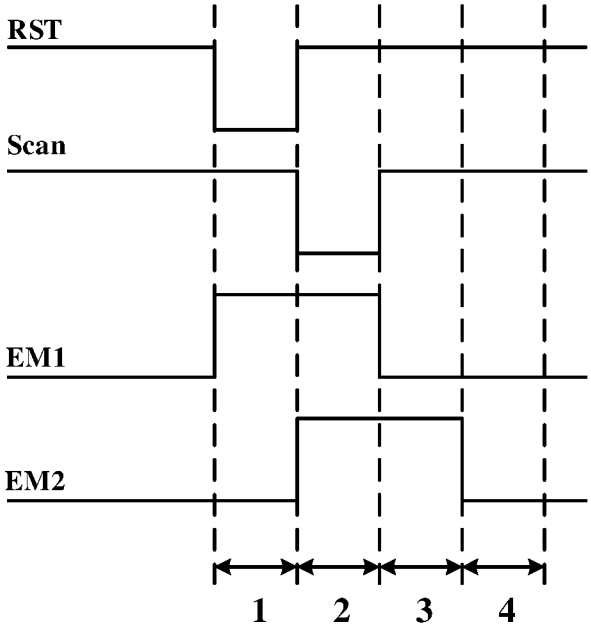
FIG. 6 is a timing diagram of a driving method provided by an embodiment of the present disclosure.

At least one embodiment of the present disclosure further provides a driving method of the pixel circuit. FIG. 6 illustrates a timing diagram of a signal applied to the pixel circuit. The driving method is described in detail with reference to FIG. 6 to FIG. 10, by taking the pixel circuit as illustrated in FIG. 5 as an example. However, for example, the pixel circuit as illustrated in FIG. 3 may adopt the same or similar signal timing.

For example, as illustrated in FIG. 6, the driving method includes four stages, namely a reset stage 1, a data writing and compensation stage 2, a charging and holding stage 3, and a light emitting stage 4. A waveform of timing sequence of each signal in each stage is illustrated in FIG. 6.

Figure 7:
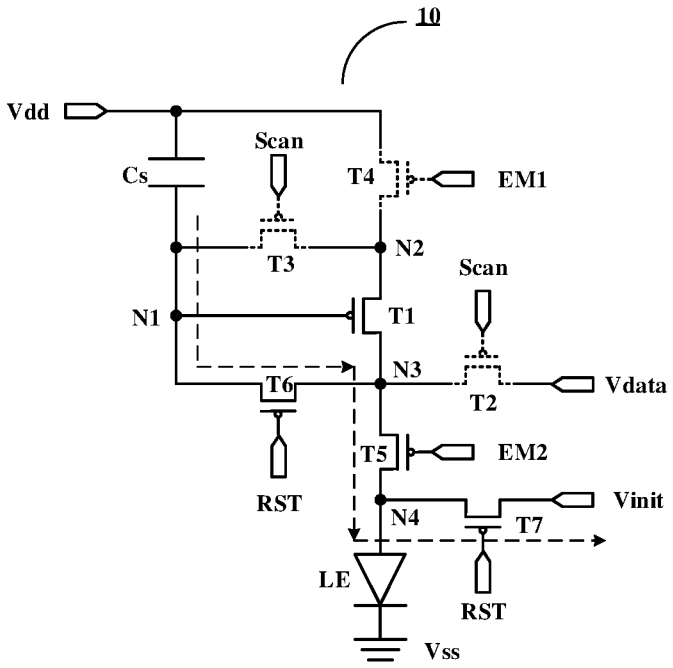
FIG. 7 to FIG. 10 are respectively circuit diagrams of the pixel circuit, corresponding to four stages as illustrated in FIG. 6, as illustrated in FIG. 5.
Figure 8:
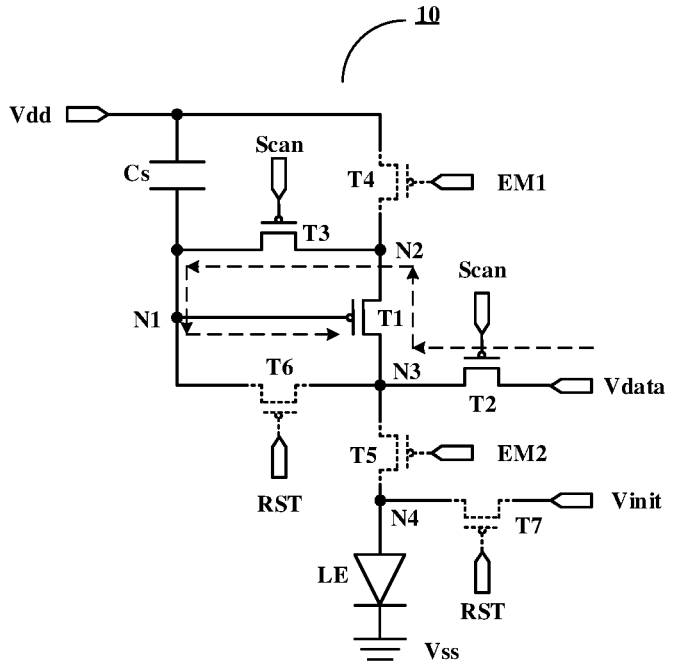
Figure 9:
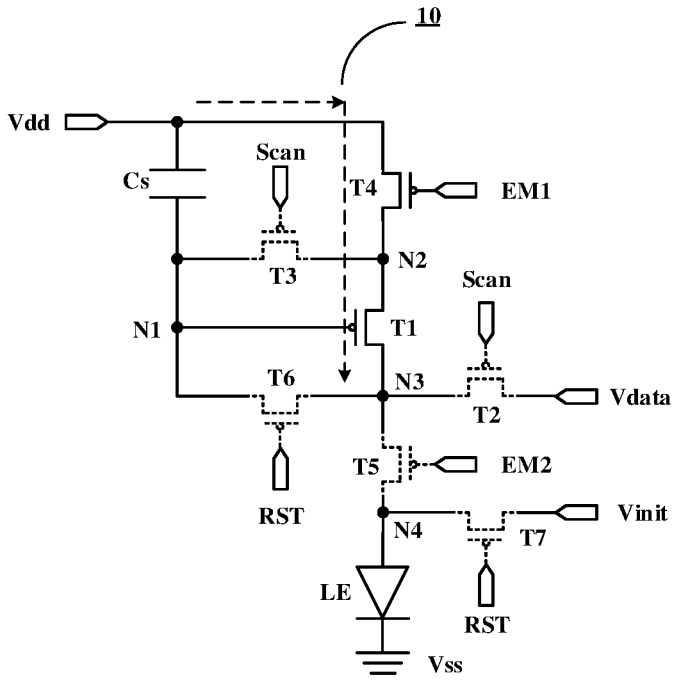
Figure 10:
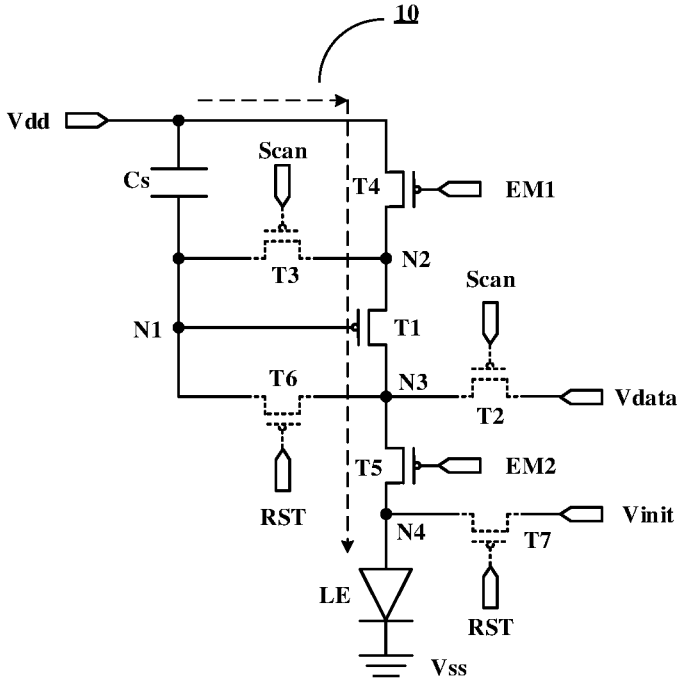

It should be noted that FIG. 7 is a schematic diagram when the pixel circuit as illustrated in FIG. 5 is in the reset stage 1, FIG. 8 is a schematic diagram when the pixel circuit as illustrated in FIG. 5 is in the data writing and compensation stage 2, FIG. 9 is a schematic diagram when the pixel circuit as illustrated in FIG. 5 is in the charging and holding 3, and FIG. 10 is a schematic diagram when the pixel circuit as illustrated in FIG. 5 is in the light emitting stage 4. In addition, the transistors illustrated by dashed lines in FIG. 7 to FIG. 10 are all in the turned-off state in corresponding stages, and the dashed lines with arrows in FIG. 7 to FIG. 10 indicate the current direction of the pixel circuit in corresponding stages. The case that the transistors illustrated in FIG. 7 to FIG. 10 are all P-type transistors is taken as an example, that is, the gate electrode of each transistor is turned on when receiving a low level and is turned off when receiving a high level. The following examples are the same and are not be repeated.

In the reset stage 1, the reset signal RST and the second light emission control signal EM2 are input, the first reset circuit 610, the second reset circuit 620 and the second light emission control circuit 500 are turned on, and the compensation circuit 300, the driver circuit 100 and the light emitting element 700 are reset.

As illustrated in FIGS. 6 and 7, in the reset stage 1, the sixth transistor T6 and the seventh transistor T7 are turned on by a low level of the reset signal RST, and the fifth transistor T5 is turned on by a low level of the second light emission control signal EM2. Meanwhile, the second transistor T2 and the third transistor T3 are turned off by a high level of the scan signal Scan, and the fourth transistor T4 is turned off by a high level of the first light emission control signal EM1.

As illustrated in FIG. 7, in the reset stage 1, a reset path is formed (as illustrated by the dashed line with arrows in FIG. 7). Because the reset voltage Vinit is a low-level signal (for example, it may be a grounded signal or other low-level signals), the storage capacitor Cs discharges via the reset path, thereby resetting potentials of all of the first node N1, the third node N3 and the fourth node N4.

In the reset stage 1, the storage capacitor Cs is reset to discharge the charge stored in the storage capacitor Cs, so that data signals in subsequent stages can be stored in the storage capacitor Cs more quickly and reliably. Meanwhile, the fourth node N4 is also reset, that is, the OLED is reset, so that the OLED can be displayed as a black state without emitting light before the light emitting stage 4, and a display effect such as contrast of a display device adopting the pixel circuit described above is improved.

In the data writing and compensation stage 2, the scan signal Scan and the data signal Vdata are input, and the switch circuit 200, the driver circuit 100 and the compensation circuit 300 are turned on. The switch circuit 200 writes the data signal Vdata into the driver circuit 100, and the compensation circuit 300 compensates the driver circuit 100.

As illustrated in FIGS. 6 and 8, in the data writing and compensation stage 2, the second transistor T2 and the third transistor T3 are turned on by a low level of the scan signal Scan. In this case, because of the conduction of the third transistor T3, the first transistor T1 is in a connection mode allowing the first transistor T1 to be similar to a diode. Meanwhile, the fourth transistor T4 is turned off by the high level of the first light emission control signal EM1, the fifth transistor T5 is turned off by a high level of the second light emission control signal EM2, and both the sixth transistor T6 and the seventh transistor T7 are turned off by a high level of the reset signal RST.

As illustrated in FIG. 8, in the data writing and compensation stage 2, a data writing path is formed (as illustrated by the dashed line with arrows in FIG. 8). After the data signal Vdata passes through the second transistor T2, the first transistor T1 and the third transistor T3, the first node N1 is charged (for example, the storage capacitor Cs is charged), that is, a potential of the first node N1 increases. It is easy to understand that a potential of the third node N3 is kept to be Vdata, and in this case, according to the characteristics of the first transistor T1, when the potential of the first node N1 increases to Vdata+Vth, the first transistor T1 is turned off and the charging process ends. It should be noted that Vth represents the threshold voltage of the first transistor. Because the first transistor T1 is described by taking a P-type transistor as an example in the present disclosure, the threshold voltage Vth can be a negative value here.

After the data writing and compensation stage 2, the potentials of the first node N1 and the second node N2 are both Vdata+Vth, that is, the voltage information with the data signal Vdata and the threshold voltage Vth is stored in the storage capacitor Cs for providing a gray scale display data and compensating the threshold voltage of the first transistor T1 in the subsequent light emitting stage.

In the charging and holding stage 3, the first light emission control signal EM1 is input, and the first light emission control circuit 400 and the driver circuit 100 are turned on. The first light emission control circuit 400 applies the first voltage Vdd to the driver circuit 100 and holds the voltage of the control terminal 130 of the driver circuit 100.

As illustrated in FIG. 6 and FIG. 9, in the charging and holding stage 3, the fourth transistor T4 is turned on by the low level of the first light emission control signal EM1. The second transistor T2 and the third transistor T3 are turned off by the high level of the Scan signal Scan, the fifth transistor T5 is turned off by the high level of the second light emission control signal EM2, and the sixth transistor T6 and the seventh transistor T7 are turned off by the high level of the reset signal RST.

As illustrated in FIG. 9, in the charging and holding stage 3, because both the third transistor T3 and the sixth transistor T6 are turned off and the first node N1 has no discharge path, the potential of the first node N1 is kept to be the potential of the previous stage, namely Vdata+Vth. Because the first transistor T1 and the fourth transistor T4 are turned on, a charging path is formed (as illustrated by the dashed line with arrows in FIG. 9), thereby charging the potentials of the second node N2 and the third node N3 up to the first voltage Vdd.

In the light-emitting stage 4, the first light emission control signal EM1 and the second light emission control signal EM2 are input, the first light emission control circuit 400, the second light emission control circuit 500 and the driver circuit 100 are turned on, and the second light emission control circuit 500 applies a driving current to the light emitting element 700 to enable the light emitting element 700 to emit light.

As illustrated in FIG. 6 and FIG. 10, in the light emitting stage 4, the second transistor T2 and the third transistor T3 are turned off by the high level of the scan signal Scan, and both the sixth transistor T6 and the seventh transistor T7 are turned off by the high level of the reset signal RST. The fourth transistor T4 is turned on by the low level of the first light emission control signal EM1, the fifth transistor T5 is turned on by the low level of the second light emission control signal EM2, and the first transistor T1 is also kept to be turned on at this stage.

As illustrated in FIG. 10, in the light emitting stage 4, a driving light emitting path is formed (as illustrated by the dashed line with arrows in FIG. 10). The positive terminal and the negative terminal of the light emitting element LE are respectively received with the first voltage Vdd (high voltage) and the second voltage Vss (low voltage), and thus the light emitting element LE emits light under an action of a driving current flowing through the first transistor T1. The potential of the first node N1 is kept to be the potential of the previous stage, that is, Vdata+Vth, and the potential of the third node N3 is also kept to be the potential of the previous stage, that is, Vdd.

Specifically, a value of the driving current ILE flowing through the light emitting element LE can be obtained according to the following formula:

$$\begin{aligned} I_{LE} &= K(Vgs - Vth)^2 \\ &= K[(Vdata + Vth - Vdd) - Vth]^2 \\ &= K(Vdata - Vdd)^2 \end{aligned}$$

In the above formula, Vth represents the threshold voltage of the first transistor T1, Vgs represents the voltage between the gate electrode of the first transistor T1 and the first electrode such as the source of the first transistor T1, and K is a constant value. From the above formula, it can be seen that the driving current ILE flowing through the light emitting element LE is no longer related to the threshold voltage Vth of the first transistor T1, but only related to the data signal Vdata controlling the gray scale of light emission of the pixel circuit. Therefore, a compensation to the pixel circuit is realized, a threshold voltage drifting problem of the driving transistor (the first transistor T1 in the embodiments of the present disclosure) caused by the manufacturing process and a long operation is solved, and an influence on the driving current ILE caused by the above problem is eliminated. Thus, the display effect is improved.

In the above driving method, as illustrated in FIG. 6, the second emission control signal EM2 is different from the first emission control signal EM1, and the second emission control signal EM2 and the reset signal RST are at least turn-on signals at the same time. For example, in the reset stage 1, both of the second emission control signal EM2 and the reset signal RST are turn-on signals.

It should be noted that the driving method for the pixel circuit as illustrated in FIG. 3 is similar to the driving method in the above-mentioned embodiment and is not described here again.

Figure 11:
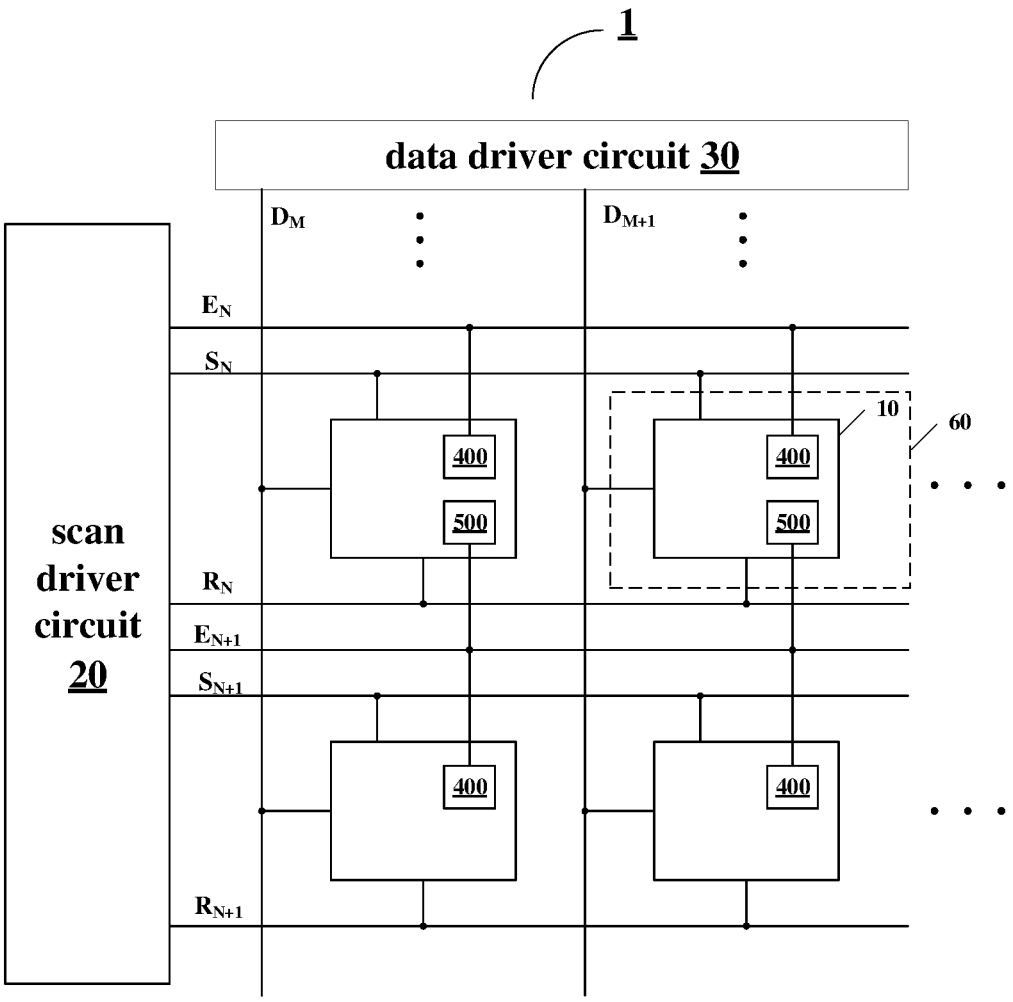
FIG. 11 is a schematic diagram of a display device provided by an embodiment of the present disclosure.

At least one embodiment of the present disclosure also provides a display device 1. As illustrated in FIG. 11, the display device 1 includes a plurality of pixel units 60 arranged in an array, a plurality of scan signal lines, a plurality of data signal and a plurality of reset control lines. It should be noted that only a part of the pixel units 60, a part of the scan signal lines, a part of the data signal lines, and a part of the reset control lines are illustrated in FIG. 11. For example, $S_N$ represents the scan signal line in a Nth row, and $S_{N+1}$ represents the scan signal line in a (N+1)th row; $R_N$ represents the reset control line in the Nth row, and $R_{N+1}$ represents the reset control line in the (N+1)th row; $D_M$ represents the data signal line in an Mth column, and $D_{M+1}$ represents the data signal line in an (M+1)th column. N and M are integers larger than 0 here.

For example, each of the pixel units 60 includes any one of the pixel circuits 10 provided in the above embodiments, for example, each of the pixel units 60 includes the pixel circuit 10 as illustrated in FIG. 5.

For example, the scan signal line in each row is connected to the switch circuits 200 and the compensation circuits 300 of the pixel circuits in the each row to provide the scan signal Scan; the data signal line in each column is connected to the switch circuits 200 of the pixel circuits in the each column to provide the data signal Vdata; the reset control line in each row is connected to the reset circuits 600 of the pixel circuits in the each row to provide the reset signal RST (not illustrated in the figures).

For example, in a case where the pixel circuit 10 includes the first light emission control circuit 400 and the second light emission control circuit 500, the display device 1 further includes a plurality of light emission control lines. Only the light emission control line $E_N$ of the Nth row and the light emission control line $E_{N+1}$ of the (N+1)th row are illustrated in FIG. 11.

As illustrated in FIG. 11, the first light emission control circuits 400 of the pixel circuits 10 in the Nth row are connected to the light emission control line $E_N$ in the Nth row. The second light emission control circuits 500 of the pixel circuits 10 in the Nth row is connected to the light emission control line $E_{N+1}$ of the (N+1)th row; the first light emission control circuits 400 of the pixel circuits 10 in the (N+1)th row is connected to the light emission control line $E_{N+1}$ of the (N+1)th row. By analogy, that is, the second light emission control circuits 500 of the pixel circuits 10 in the Nth row and the first light emission control circuits 400 of the pixel circuits 10 in the (N+1)th row share the light emission control line $E_{N+1}$ in the (N+1)th row.

It should be noted that the display device 1 as illustrated in FIG. 11 may further include a plurality of first voltage lines and a plurality of reset voltage lines to respectively provide the first voltage Vdd and the reset voltage Vinit (not illustrated in the figure).

For example, as illustrated in FIG. 11, the display device 1 may further include a scan driver circuit 20 and a data driver circuit 30.

For example, the data driver circuit 30 are connected to the plurality of data signal lines ($D_M$, $D_{M+1}$, etc.) to provide the data signal Vdata; meanwhile, the data driver circuit 30 may also be connected to the plurality of first voltage lines (not illustrated) and the plurality of reset voltage lines (not illustrated) to respectively provide the first voltage Vdd and the reset voltage Vinit.

For example, the scan driver circuit 20 is connected to the plurality of scan signal lines ($S_N$, $S_{N+1}$, etc.) to provide a scan signal Scan; meanwhile, the scan driver circuit 20 may also be connected with a plurality of light emitting control lines ($E_N$, $E_{N+1}$, etc.) to provide a light emitting control signal, and be connected with the plurality of reset control lines ($R_N$, $R_{N+1}$, etc.) to provide the reset signal.

For example, the scan driver circuit 20 and the data driver circuit 30 may be implemented as semiconductor chips. The display device 1 may also include other components, such as a timing controller, a signal decoding circuit, a voltage conversion circuit, etc. These components may, for example, adopt conventional components, and are not be described in detail here.

A progressive scanning process of the display device 1 is described below with reference to the driving method provided in the embodiment of the present disclosure, and the description regarding each stage can refer to corresponding descriptions in the above embodiment.

For example, after the reset stage, the pixel circuits in the Nth row receive a progressive scan signal via a scan signal line and enters the data writing and compensation stage. At this stage, the data signal Vdata and the threshold voltage Vth are written into the pixel circuits in the Nth row for providing corresponding gray scale display data and compensating the threshold voltage in the subsequent light emitting stage. It is easy to understand that, because control signals such as the reset signals are applied line by line according to a timing signal, the pixel circuits in the (N+1)th row are in the reset stage at this time.

The pixel circuits in the Nth row enter the charging and holding stage after the data writing and compensation stage. In this stage, the first light emission control circuits 400 of the pixel circuits in the Nth row are turned on by accessing a turn-on signal provided by the light emission control line $E_N$ in the Nth row; the second light emission control circuits 500 of the pixel circuits in the Nth row are turned off by accessing an turn-off signal provided by the light emission control line $E_{N+1}$ in the (N+1)th row. At this time, the pixel circuits in the (N+1)th row are in the data writing and compensation stage, and corresponding data signals Vdata and threshold voltages Vth are written into the pixel circuits in the (N+1)th row.

The pixel circuits in the Nth row enter the light emitting stage after the charging and holding stage, and the first light emission control circuits 400 of the pixel circuits in the Nth row are turned on by accessing the turn-on signal provided by the light emitting control line $E_N$ in the Nth row; the second light emission control circuits 500 of the pixel circuits in the Nth row are turned on by accessing a turn-on signal provided by the light emission control line $E_{N+1}$ in the (N+1)th row, so that the pixel circuits in the Nth row realize light emitting and display function. At the same time, the turn-on signal provided by the light-emitting control line $E_{N+1}$ in the (N+1)th row is also provided to the first light emission control circuits 400 of the pixel circuits in the (N+1)th row, so that the pixel circuits in the (N+1)th row are in the charging and holding stage. It is easy to understand that, at this time, the second light emission control circuits 500 of the pixel circuits in the (N+1)th row is turned off by accessing an turn-off signal provided by the light emission control line in the (N+2)th row. At a next moment, the pixel circuit in the (N+1)th row can realize light emitting and display function, and so on, such that the progressive scanning based display are realized.

In the display device 1 provided by embodiments of the present disclosure, because the pixel circuits in the Nth row and the pixel circuits in the (N+1)th row share the same one light emission control line, the layout and the developing of the display device 1 are simplified. Other technical effects may refer to the technical effects of the pixel circuit provided in embodiments of the present disclosure and are not be repeated here.

For example, the display device 1 provided by embodiments of the present disclosure may be any product or component with a display function such as an electronic paper, a mobile phone, a tablet computer, a television, a display, a notebook computer, a digital photo frame, a navigator, etc.

What have been described above are only specific implementations of the present disclosure, the protection scope of the present disclosure is not limited thereto. The protection scope of the present disclosure should be based on the protection scope of the claims.

What is claimed is:

1. A pixel circuit, comprising a switch circuit, a driver circuit, a compensation circuit, a reset circuit and a light emitting element, wherein the driver circuit comprises a control terminal, a first terminal and a second terminal and is configured to control a driving current running through the first terminal and the second terminal, and the driving current is used to drive the light emitting element to emit light;

the switch circuit is configured to write a data signal to the control terminal of the driver circuit in response to a scan signal;

the compensation circuit is configured to store the data signal that is written in and further configured to electrically connect the control terminal of the driver circuit and the second terminal of the driver circuit in response to the scan signal; and the reset circuit is configured to apply a reset voltage to the compensation circuit in response to a reset signal and electrically connect the control terminal of the driver circuit and the first terminal of the driver circuit.

2. The pixel circuit according to claim 1, further comprising:

a first light emission control circuit configured to apply a first voltage to the second terminal of the driver circuit and the compensation circuit in response to a first light emission control signal.

3. The pixel circuit according to claim 2, further comprising:

a second light emission control circuit configured to apply the driving current to the light emitting element in response to a second light emission control signal.

4. The pixel circuit according to claim 3, wherein the reset circuit comprises a first reset circuit and a second reset circuit, the first reset circuit is configured to electrically connect the control terminal of the driver circuit and the first terminal of the driver circuit in response to the reset signal, and the second reset circuit is configured to apply the reset voltage to the compensation circuit in response to the reset signal.

5. The pixel circuit according to claim 4, wherein the second reset circuit is electrically connected with the control terminal of the driver circuit and the compensation circuit so as to apply the reset voltage to the control terminal of the driver circuit and the compensation circuit.

6. The pixel circuit according to claim 4, wherein the second reset circuit is electrically connected with the second light emission control circuit and the light emitting element, so as to apply the reset voltage to the light emitting element and to apply the reset voltage to the compensation circuit via the first reset circuit.

7. The pixel circuit according to claim 4, wherein the driver circuit comprises a first transistor, a gate electrode of the first transistor serves as the control terminal of the driver circuit and is connected with a first node, a first electrode of the first transistor serves as the first terminal of the driver circuit and is connected with a third node, and a second electrode of the first transistor serves as the second terminal of the driver circuit and is connected with a second node.

8. The pixel circuit according to claim 7, wherein the switch circuit comprises a second transistor, a gate electrode of the second transistor is configured to be connected with a scan signal terminal so as to receive the scan signal, a first electrode of the second transistor is configured to be connected with a data signal terminal so as to receive the data signal, and a second electrode of the second transistor is connected with the third node.

9. The pixel circuit according to claim 8, wherein the compensation circuit comprises a third transistor and a storage capacitor, a gate electrode of the third transistor is configured to be connected with the scan signal terminal so as to receive the scan signal, a first electrode of the third transistor is connected with the second node, a second electrode of the second transistor is connected with a first electrode of the storage capacitor, and a second electrode of the storage capacitor is configured to be connected with a first voltage terminal so as to receive the first voltage;

the first light emission control circuit comprises a fourth transistor, a gate electrode of the fourth transistor is configured to be connected with a first light emission control terminal so as to receive the first light emission control signal, a first electrode of the fourth transistor is configured to be connected with the first voltage terminal so as to receive the first voltage, and a second electrode of the fourth transistor is connected with the second node;

the second light emission control circuit comprises a fifth transistor, a gate electrode of the fifth transistor is configured to be connected with a second light emission control terminal so as to receive the second light emission control signal, a first electrode of the fifth transistor is connected with the third node, and a second electrode of the fifth transistor is connected with a first electrode of the light emitting element, and a second electrode of the light emitting element is configured to be connected with a second voltage terminal so as to receive a second voltage; and the first reset circuit comprises a sixth transistor, a gate electrode of the sixth transistor is configured to be connected with a reset control terminal so as to receive the reset signal, a first electrode of the sixth transistor is connected with the first node, and a second electrode of the sixth transistor is connected with the third node.

10. The pixel circuit according to claim 7, wherein the compensation circuit comprises a third transistor and a storage capacitor, a gate electrode of the third transistor is configured to be connected with a scan signal terminal so as to receive the scan signal, a first electrode of the third transistor is connected with the second node, a second electrode of the second transistor is connected with a first electrode of the storage capacitor, and a second electrode of the storage capacitor is configured to be connected with a first voltage terminal so as to receive the first voltage.

11. The pixel circuit according to claim 7, wherein the first light emission control circuit comprises a fourth transistor, a gate electrode of the fourth transistor is configured to be connected with a first light emission control terminal so as to receive the first light emission control signal, a first electrode of the fourth transistor is configured to be connected with a first voltage terminal so as to receive the first voltage, and a second electrode of the fourth transistor is connected with the second node.

12. The pixel circuit according to claim 7, wherein the second light emission control circuit comprises a fifth transistor, a gate electrode of the fifth transistor is configured to be connected with a second light emission control terminal so as to receive the second light emission control signal, a first electrode of the fifth transistor is connected with the third node, and a second electrode of the fifth transistor is connected with a first electrode of the light emitting element, and a second electrode of the light emitting element is configured to be connected with a second voltage terminal so as to receive a second voltage.

13. The pixel circuit according to claim 7, wherein the first reset circuit comprises a sixth transistor, a gate electrode of the sixth transistor is configured to be connected with a reset control terminal so as to receive the reset signal, a first electrode of the sixth transistor is connected with the first node, and a second electrode of the sixth transistor is connected with the third node.

14. The pixel circuit according to claim 7, wherein the second reset circuit comprises a seventh transistor, a gate electrode of the seventh transistor is configured to be connected with a reset control terminal to receive the reset signal, a first electrode of the seventh transistor is connected with the first node, and a second electrode of the seventh transistor is configured to be connected with the a reset voltage terminal to receive the reset voltage.

15. The pixel circuit according to claim 7, wherein the second reset circuit comprises a seventh transistor, a gate electrode of the seventh transistor is configured to be connected with a reset control terminal so as to receive the reset signal, a first electrode of the seventh transistor is connected with a first electrode of the light emitting element, and a second electrode of the seventh transistor is configured to be connected with the a reset voltage terminal so as to receive the reset voltage.

16. A display device, comprising:

a plurality of pixel units which are arranged in an array, a plurality of scan signal lines, a plurality of data signal lines and a plurality of reset control lines, wherein each of the plurality of pixel units comprises the pixel circuit according to claim 1;

a scan signal line in each row is connected with switch circuits and compensation circuits of pixel circuits in the each row to provide a scan signal;

a data signal line in each column is connected with switch circuits of pixel circuits in the each column to provide a data signal; and a reset control line in the each row is connected with reset circuits of the pixel circuits in the each row to provide a reset signal.

17. The display device according to claim 16, further comprising a plurality of light emission control lines, wherein each pixel circuit further comprises:

a first light emission control circuit configured to apply a first voltage to a second terminal of a driver circuit and a compensation circuit of the each pixel circuit in response to a first light emission control signal; and a second light emission control circuit configured to apply a driving current of the each pixel circuit to a light emitting element of the each pixel circuit in response to a second light emission control signal, wherein the second light emission control signal is different from the first light emission control signal;

first light emission control circuits of pixel circuits in an Nth row is connected with a light emission control line in the Nth row;

second light emission control circuits of the pixel circuits in the Nth row is connected with a light emission control line in an (N+1)th row;

first light emission control circuits of pixel circuits in the (N+1)th row is connected with the light emission control line in the (N+1)th row; and N is an integer larger than zero.

18. The pixel circuit according to claim 3, wherein the second light emission control signal is different from the first light emission control signal.

19. A driving method of a pixel circuit, wherein the pixel circuit comprises a switch circuit, a driver circuit, a compensation circuit, a reset circuit and a light emitting element, wherein the driver circuit comprises a control terminal, a first terminal and a second terminal and is configured to control a driving current running through the first terminal and the second terminal, and the driving current is used to drive the light emitting element to emit light;

the switch circuit is configured to write a data signal to the control terminal of the driver circuit in response to a scan signal;

the compensation circuit is configured to store the data signal that is written in and further configured to electrically connect the control terminal of the driver circuit and the second terminal of the driver circuit in response to the scan signal; and the reset circuit is configured to apply a reset voltage to the compensation circuit in response to a reset signal and electrically connect the control terminal of the driver circuit and the first terminal of the driver circuit, the driving method comprises: a reset stage, a data writing and compensation stage, and a light emitting stage, wherein, during the reset stage, the reset signal is input, the reset circuit is turned on, and the compensation circuit and the driver circuit are reset;

during the data writing and compensation stage, the scan signal and the data signal are input, all of the switch circuit, the driver circuit and the compensation circuit are turned on, the switch circuit writes the data signal into the driver circuit, and the compensation circuit compensates the driver circuit; and during the light emitting stage, the driver circuit drives the light emitting element to emit light.

20. The driving method of the pixel circuit according to claim 19, wherein the pixel circuit further comprises:

a first light emission control circuit configured to apply a first voltage to the second terminal of the driver circuit and the compensation circuit in response to a first light emission control signal, and a second light emission control circuit configured to apply the driving current to the light emitting element in response to a second light emission control signal, wherein the reset circuit comprises a first reset circuit and a second reset circuit, the first reset circuit is configured to electrically connect the control terminal of the driver circuit and the first terminal of the driver circuit in response to the reset signal, and the second reset circuit is configured to apply the reset voltage to the compensation circuit in response to the reset signal;

the driving method further comprises: a charging and holding stage, wherein, during the reset stage, the reset signal and the second light emission control signal are input, all of the first reset circuit, the second reset circuit and the second light emission control circuit are turned on, and all of the compensation circuit, the driver circuit and the light emitting element are reset;

during the data writing and compensation stage, the scan signal and the data signal are input, all of the switch circuit, the driver circuit and the compensation circuit are turned on, the switch circuit writes the data signal into the driver circuit, and the compensation circuit compensates the driver circuit;

during the charging and holding stage, the first light emission control signal is input, the first light emission control circuit and the driver circuit are turned on, and the first light emission control circuit applies the first voltage to the driver circuit and holds a voltage at a control terminal of the driver circuit; and during the light emitting stage, the first light emission control signal and the second light emission control signal are input, all of the first light emission control circuit, the second light emission control circuit and the driver circuit are turned on, and the second light emission control circuit applies the driving current to the light emitting element to enable the light emitting element to emit light, wherein the second light emission control signal is different from the first light emission control signal, and the second light emission control signal and the reset signal are at least turn-on signals at same time.

* * * * *